United States Patent [19]

LaBate

[11] 4,239,818

[45] Dec. 16, 1980

[54] PROCESS AND MATERIAL FOR TREATING STEEL WALLS AND FANS IN ELECTRICAL PRECIPITATION INSTALLATIONS WITH MICRON COLLOIDAL GRAPHITE PARTICLES

[76] Inventor: Michael D. LaBate, 115 Hazen Ave., Ellwood City, Pa. 16117

[21] Appl. No.: 59,303

[22] Filed: Jul. 20, 1979

Related U.S. Application Data

[63] Continuation-in-part of Ser. No. 956,497, Nov. 1, 1978, Pat. No. 4,187,334.

[51] Int. Cl.[3] ..... B05D 7/22; B05D 3/02; B05D 3/00; B05D 3/12

[52] U.S. Cl. ..... 427/236; 427/239; 427/318; 427/327; 427/372.2

[58] Field of Search ..... 427/236, 239, 318, 327, 427/372.2

[56] References Cited

U.S. PATENT DOCUMENTS

| | | | |
|---|---|---|---|
| 2,245,747 | 6/1941 | Barr | 427/135 |
| 2,246,463 | 6/1941 | Garratt | 427/318 X |
| 2,618,032 | 11/1952 | Traenkaer | 106/38.22 X |
| 4,098,929 | 7/1978 | Badone et al. | 427/135 X |

FOREIGN PATENT DOCUMENTS

| | | | |
|---|---|---|---|
| 251401 | 11/1960 | Australia | 427/135 |
| 785823 | 11/1957 | United Kingdom | 427/135 |
| 1198363 | 7/1970 | United Kingdom | 427/135 |

*Primary Examiner*—Michael R. Lusignan
*Attorney, Agent, or Firm*—Webster B. Harpman

[57] ABSTRACT

A process of treating the interior steel walls and gas and/or air moving fans or blowers in electrical precipitation installations with a material containing micro micron sized particles of graphite in a liquid carrier is described that forms a penetrating lubricating adhesive coating on the interior walls and fan blades and blower parts of the electrical precipitation installations and which acts to prevent the accumulation of coal, tar, dust, fly ash and other particles thereon.

5 Claims, No Drawings

PROCESS AND MATERIAL FOR TREATING STEEL WALLS AND FANS IN ELECTRICAL PRECIPITATION INSTALLATIONS WITH MICRON COLLOIDAL GRAPHITE PARTICLES

This is a continuation in part of Ser. No. 956,497, filed Nov. 1, 1978, now U.S. Pat. No. 4,187,334, patented Feb. 5, 1980.

BACKGROUND OF THE INVENTION (1) Field of the Invention

This invention relates to electrical precipitators as used in cleaning flue gasses in power plants, blast furnaces, coke ovens and the like and a method and material for treating the steel parts of such devices to prevent circulation restricting accumulation of particulate matter therein.

(2) Description of the Prior Art

Fossil fueled power plants, such as used in electrical and steam generating installations, blast furnaces and coke ovens, have heretofore been provided with various flue gas scrubbers and electrical precipitators for removing particulate material which would otherwise be discharged with the flue gasses and pollute the atmosphere. The electrical precipitators collect solid or liquid particles suspended in a gas by means of a unidirectional electric field, the precipitated particles being attracted to and collected on the positive electrode of the precipitator. In order that the solid or liquid particles may reach the positive electode of the precipitator, the communicating passageways must be kept open and the prior art installations have provided no means of assuring the non-blocking accumulation of particles in such passageways.

In electrical power or steam generating plants, considerable fly ash and other objectionable particulate matter is encountered. In blast furnaces coke, limestone and iron ore dusts are produced and in coke ovens coal tar and other by-products build up deposits which are difficult to remove and which like the other particulate matter accumulate and block the passageways through the precipitators.

The present invention relates to a process of building up a penetrating coating on the inner walls and fan blades or blower parts in the electrical precipitation devices with a material that is not affected by the heat of the operation and to which tar and other solid or liquid particles suspended in a gas will not adhere with the result that the passageways, fan blades and/or blower parts remain clean and free of solid or liquid particle build up.

The material used in the process forms a penetrating and lubricating adhesive coating on the fan blades and/or blower parts in electrical precipitation installations. No prior art is known which relates to a material capable of such use or a process of using it.

SUMMARY OF THE INVENTION

A process and material for treating the interior steel walls and fans and blowers in electrical precipitation installations to prevent the build up of solid or liquid particles suspended in the gasses being treated comprising a coating of the inner walls and steel fan blades and blower parts as by spraying or other application with a material which is essentially micro micron graphite particles in a liquid carrier wherein the extremely fine size of the graphite particles lowers the surface tension of the liquid carrier and enables the graphite to penetrate the surfaces of the steel walls, fan blades and blower parts being treated and build up a smooth adhering coating.

The liquid carrier comprises water, an aqueous sodium silicate solution and hydrochloric acid, a water soluable resin such as carboxy vinyl polymer as a dry fluffy acid powder is power mixed with the micro micron graphite particles and the liquid carrier to obtain a suitable solution which contribute to the penetrating lubricating and adhesive coating ability of the material when applied to the precipitation apparatus.

DESCRIPTION OF THE PREFERRED EMBODIMENT

The material of this invention is particularly suitable for building up penetrating and lubricating adhesive smooth surface coatings on the inner steel walls of electrical precipitation installations including fan steel blades and blower parts therein and comprises substantially between about 5% to 25% by weight micro micron particles of graphite, between about 34% to 75% by weight of a solution of water and sodium silicate (Na Si O) wherein the water is present at about 60% of the solution, between about 2% to 10% concentrated hydrochloric acid of a 90% purity weight, between about 33% to 75% of a solution of water acid carboxy vinyl polymer resin wherein the resin is present in amounts between 1% to 10% of the solution by weight and between about 15% to 20% water by weight. The particle size of the micro micron graphite is about one-millionth of a micron sized particle. A micron sized particle is between 0.2 and 10$\mu$ ($\mu$=one-millionth of).

The carboxy vinyl resin powder has a specific gravity of 1.41 and a bulk density 13 lbs. per cubic foot. It is available commercially as "CARBOPOL" and low concentrations mixed with water as herein disclosed produce a thin gel-like liquid with penetrating and adhesive qualities.

Those skilled in the art will observe that the liquid carrier as set forth hereinbefore comprises an effective wetting agent which contributes to the ability of the micro micron particles of graphite to penetrate the metal comprising the inner walls, fan blades and/or blower parts or the electrical precipitation installations, and form a dry smooth lubricating adhesive coating.

Those skilled in the art will also observe that the percentages of the micro micron particles of graphite in the liquid carrier may be varied depending upon the number of applications of the material to the metal parts being treated and it has been determined that some metals used in the duct work walls, fan blades, and blower parts in electrical precipitation installations are advantageously treated in accordance with this invention by preheating said metal surfaces and/or parts immediately prior to the application of the material in the process herein disclosed.

For example small percentages of the micro micron particles of graphite in the liquid carrier perform effectively when a number of applications of the material are applied and when only one or a few applications of the material are applied to the metal surfaces then the higher percentages of the micro micron particles of graphite are desirable. In either case the material penetrates the metal surfaces being treated and builds up an extremely smooth slick surface coating to which fly ash and other particulate matter including solid or liquid particles suspended in the flue gases will not adhere of if some adherence occurs the adhering material may be easily removed from the treated surfaces by air jets or the like.

In using the material disclosed herein, the process involves mixing the material to form a liquid suspension of the micro micron particles of graphite and then spraying the same by any suitable spraying equipment on cleaned metal surfaces of the inner steel walls, fan blades, and/or blower parts of the electrical precipitation installations being treated. One or more coatings are applied as necessary to build up a smooth unbroken surface of the material on the metal surfaces being treated and the material may be applied to the metal surfaces while they are either hot or cold as aforesaid. The ability of the material to be applied to and remain on hot steel surfaces is particularly advantageous in power plants, blast furnace and coke oven installations as the flue gases being handled are of a high temperature.

Those skilled in the art will observe that the heretofore necessary manual cleaning of the inner steel wall surfaces, fan blades and/or blower parts required considerable down time of the particular electrical precipitation installation being cleaned and that this down time is now largely eliminated through the use of the material and process disclosed herein.

It will be observed that the operation of an electrical precipitator is improved and stabilized by providing for the effective coating of the inner walls and passageways, fan blades and blower parts thereof to prevent the accumulation of materials thereon and that as customary the normal dual installations can be alternated with the cleaning of the collecting electrodes performed rapidly as the passageways, inner walls, and other parts of the circulatory systems remain clean and free of circulation interfering build ups of particular matter and the like.

The following specific examples of the material have been found satisfactory.

A. Substantially 8% by weight micro micron particles of high purity synthetic graphite, substantially 7% by weight concentrated hydrochloric acid of substantially 90% purity, substantially 18% by weight water ($H_2O$), substantially 34% by weight aqueous sodium silicate solution wherein the the Na 2i O is present at about 40% by weight of the solution and substantially 33% by weight water soluable carboxy vinyl polymer resin as a powder wherein the resin is present at substantially 8% by weight of the solution.

B. Substantially 8% by weight micro micron particles of high purity synthetic graphite, substantially 7% by weight concentrated hydrochloric acid of substantially 90% purity, substantially 18% by weight water ($H_2O$), substantially 67% by weight aqueous sodium silicate solution wherein the $Na_2Si_3O_7$ is present at about 40% by weight of the solution.

C. Substantially 8% by weight micro micron particles of high purity synthetic graphite, substantially 7% by weight concentrated hydrochloric acid of substantially 90% purity, substantially 18% by weight water ($H_2O$), substantially 67% by weight aqueous solution of carboxy vinyl polymer resin as a powder wherein the resin is present at sutbstantially 8% by weight of the aqueous solution.

An alternate liquid carrier has been found to produce a suitable suspension of the micro micron particles of graphite and substitutes xanthan gum, a natural high molecular weight linear polysaccharide, functioning as a hydrophilic colloid to maintain the micro micron particles of graphite in suspension and contribute to the penetrating lubricating adhesive coating as described hereinbefore.

A specific example of such an alternate material follows:

D. Substantially 8% by weight micro micron particles of high purity synthetic graphite, substantially 7% by weight concentrated hydrochloric acid of substantially 90% purity, substantially 18% by weight water ($H_2O$), substantially 67% by weight aqueous solution of xanthan gum as a powder wherein the gum is present at substantially 8% by weight of the aqueous solution.

Variations in the amounts of xanthan gum may be used as from 1% to 10% of the aqueous solution.

In the present process the material is preferably applied to the metal inner walls, pipes and duct work, fan blades, shafts and housing and/or blowers including the driving means therefor, all of which are preferably heated and the material applied by spraying the liquid suspension material disclosed herein. The coating formed by the material is then dried. Under such conditions the micro micron particles of graphite aided the liquid carrier penetrates the metal surfaces which have been previously cleaned and the material builds us a smooth coating, which being largely graphite, is able to resist heat and wear and maintain its penetration and coating characteristics indefinitely. At such time as the smooth surface is eroded, it may be cleaned and recoated quickly and easily.

Although the embodiments of the present invention have been limited as described hereinbefore, it will be apparent to those skilled in the art that various changes and modifications may be made in the process and the material without departing from the spirit of the invention and having thus described my invention what I claim is:

1. A process of treating the inner steel walls and fluid handling and moving devices in electrical precipitation installations that consists essentially of the steps of cleaning said steel walls and devices, penetrating a liquid suspension of micro micron particles of graphite into said cleaned steel walls and devices so as to build up a smooth adhering and lubricating coating on said steel walls and devices, said suspension including substantially between about 5% to 25% micro micron particles of graphite by weight, between about 34% to 75% by weight of a solution of water and sodium silicate, with the sodium silicate present at about 40% of the solution, between about 2% to 10% by weight concentrated hydrochloric acid, between about 33% and 75% by weight of a solution of water and carboxy vinyl polymer resin wherein the resin is present in amounts between about 1% to 10% of the solution and between about 15% to 20% by weight water and drying said coating to form a slick smooth surface.

2. The process of claim 1 and wherein several penetrating coatings of said liquid suspension of micro micron particles of graphite are applied to said steel walls and devices successively.

3. The process of claim 1 and wherein several penetrating coatings of said liquid suspension micro micron particles of graphite are sprayed on said steel walls and devices successively.

4. The process of claim 1 and wherein said steel walls and devices are heated prior to said application of said penetrating coating of said liquid suspension of micro micron particles of graphite, said walls and devices being heated to a temperature sufficient to facilitate the penetration of the said liquid suspension of micro micron particles of graphite and carrier into the steel due to the expanded grain structure of the steel by said heat.

5. A process of treating the inner steel walls and fluid handling and moving devices in electrical precipitation installations that consists essentially of the steps of cleaning said steel walls and devices, penetrating a liquid suspension of micro particles of graphite into said cleaned steel walls and devices so as to build up a smooth adhering and lubricating coating on said steel walls and devices, said suspension including substantially between 5% and 25% micro micron particles of graphite by weight, between about 34% and 75% by weight of a solution of water and sodium silicate, with the sodium silicate present at about 40% of the solution, between about 2% to 10% by weight concentrated hydrochloric acid, between about 33% and 75% by weight of a solution of water and xanthan gum wherein the gum is present in amounts between about 1% to 10% of the solution and between about 15% to 20% by weight water and drying said coating to form a slick smooth surface.

* * * * *